United States Patent [19]

Rössler

[11] 4,171,103

[45] Oct. 16, 1979

[54] APPARATUS FOR COMMINUTING WASTE MATERIALS

[75] Inventor: Kurt Rössler, Belm, Fed. Rep. of Germany

[73] Assignee: Max Frost, Maschinen- und Apparatebau, Berlin, Fed. Rep. of Germany

[21] Appl. No.: 869,752

[22] Filed: Jan. 16, 1978

[30] Foreign Application Priority Data

Jan. 19, 1977 [DE] Fed. Rep. of Germany ..... 2701897

[51] Int. Cl.[2] ..... B02C 18/06

[52] U.S. Cl. ..... 241/152 A; 241/248; 241/257 R; 241/260

[58] Field of Search ..... 241/152 A, 162, 244, 241/245, 248, 257 R, 257 G, 259, 260

[56] References Cited

U.S. PATENT DOCUMENTS

| | | | |
|---|---|---|---|
| 746,275 | 12/1903 | Bowsher | 241/162 |
| 2,977,056 | 11/1956 | Gustke | 241/162 |
| 3,429,350 | 6/1966 | Otto | 241/248 X |
| 3,450,181 | 6/1969 | Otto | 241/257 |
| 3,902,673 | 9/1975 | Berggren | 241/257 R X |

*Primary Examiner*—Robert L. Spruill
*Assistant Examiner*—Robert P. Olszewski
*Attorney, Agent, or Firm*—Peter K. Kontler

[57] ABSTRACT

Apparatus for comminuting industrial and/or bulky domestic waste materials has an upright housing with a funnel-shaped section located above a stationary counterknife which cooperates with a single rotary knife therebelow or with two rotary knifes respectively disposed thereabove and therebelow. The inner side of the funnel-shaped housing section has a downwardly sloping spiral surface which advances waste material downwardly toward the upper rotary knife or toward the counterknife and whose upper portion flares outwardly and downwardly at a gradually diminishing angle with respect to the common axis of the knives. The lower portion of the spiral surface merges gradually into the upper portion and thereupon flares outwardly and upwardly with respect to the common axis. A feeding device which rotates with the rotary knife or knives extends into the funnel-shaped section and has one or more arms whose edge portions resemble spirals or helices having a lead opposite to that of the spiral surface. The arm or arms of the feeding device cooperate with a ripping projection in the funnel-shaped section to break, deform or rip larger items of waste material, and with the spiral surface to advance the material into the range of the cutting edges on the counterknife and the upper rotary knife or the cutting edges of the counterknife and the lower rotary knife. The latter is surrounded by an outlet having a tangential duct for evacuation of comminuted material.

25 Claims, 22 Drawing Figures

Fig.12
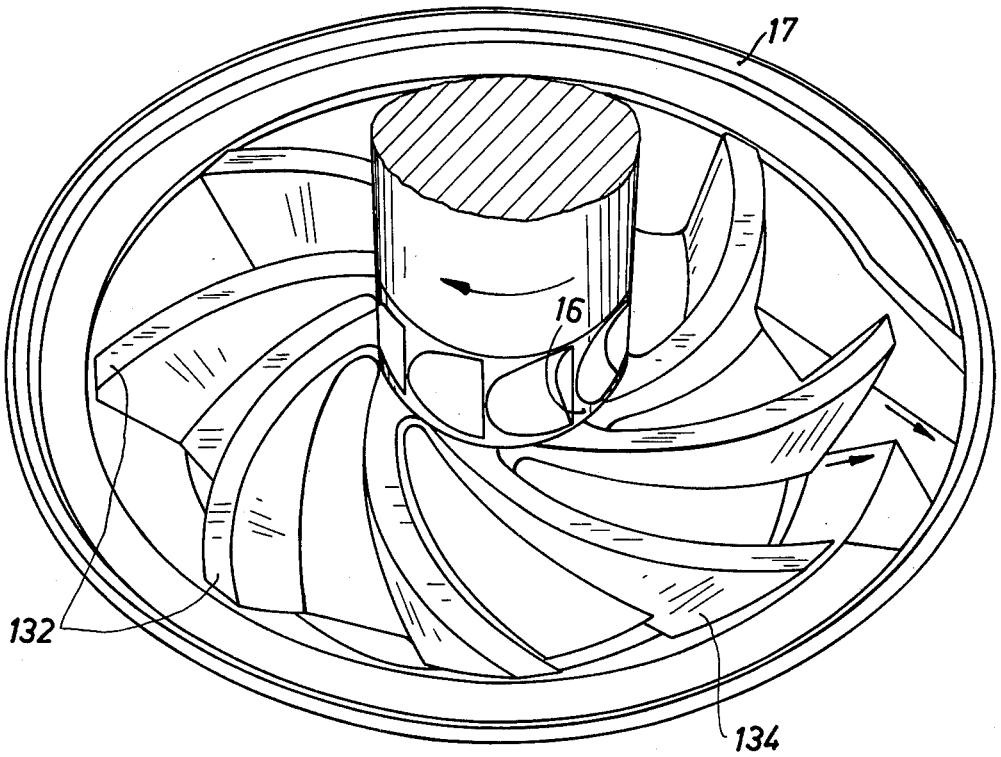
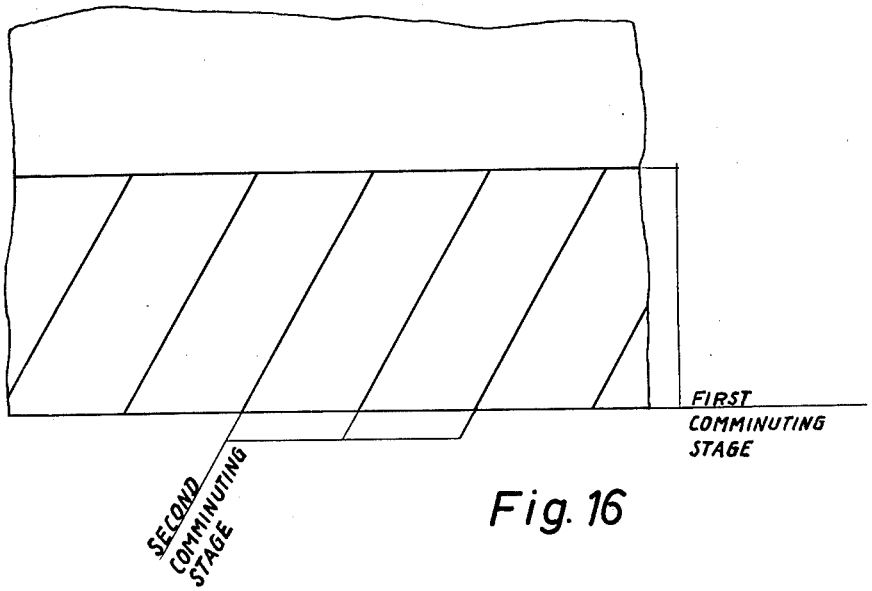
Fig. 16

Fig.19
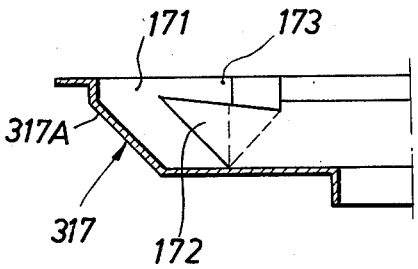
Fig.20
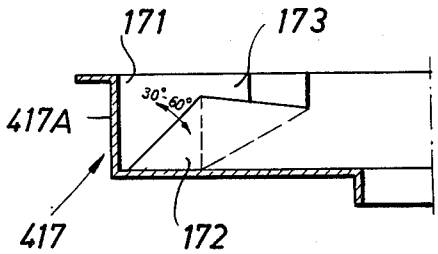
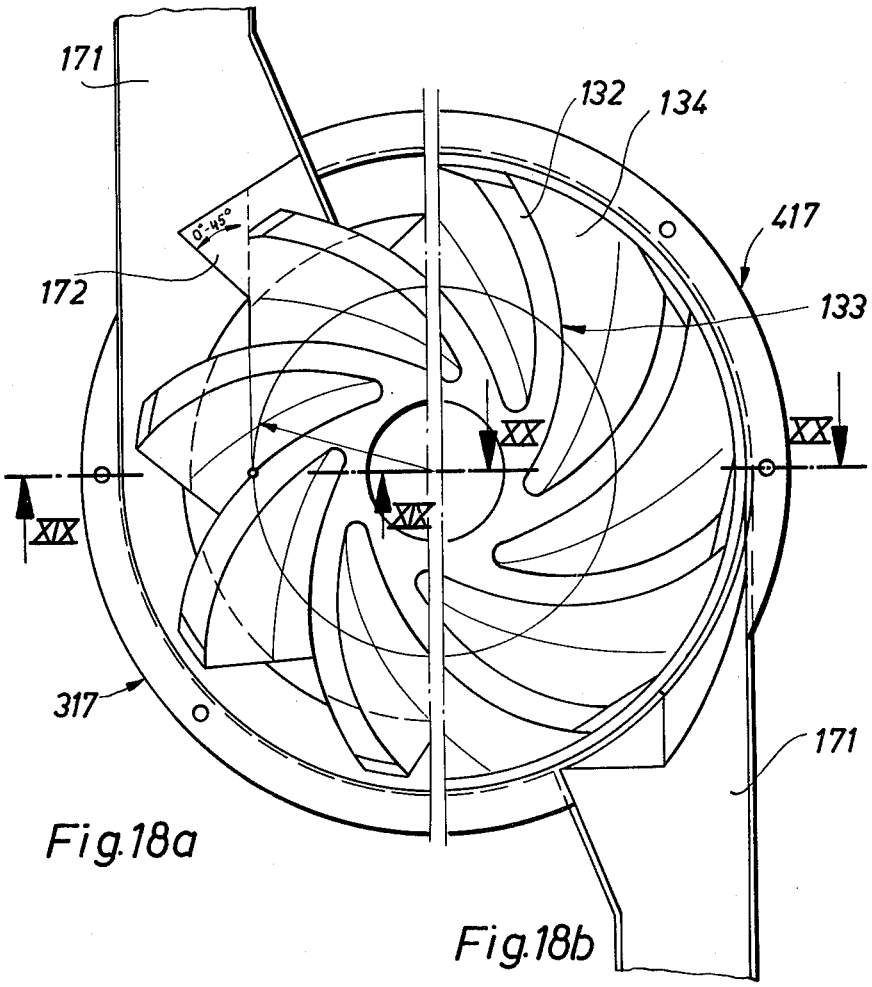
Fig.18a
Fig.18b

APPARATUS FOR COMMINUTING WASTE MATERIALS

BACKGROUND OF THE INVENTION

The present invention relates to comminuting apparatus in general, especially to improvements in apparatus for comminuting industrial and/or domestic waste. More particularly, the invention relates to improvements in comminuting apparatus of the type wherein the material to be comminuted is fed into the open upper end of a housing to be advanced downwardly into a comminuting unit having at least one rotary knife and a stationary counterknife.

German Offenlegungsschrift No. 2,424,725 discloses an apparatus which is designed to comminute industrial and/or domestic waste materials including fragments and/or parts made of sheet metal or the like. When the housing of the apparatus simultaneously receives several metallic parts (e.g., cans), such parts are engaged by tongs constituting a rotary feeding device as well by a helical internal advancing surface of the housing to be delivered into the range of the comminuting unit. The feeding device crushes the metallic parts before they reach the comminuting unit. The latter is invariably clogged when the feeding device simultaneously delivers several crushed metallic parts. The just described apparatus exhibits similar drawbacks when the material to be comminuted constitutes or includes bulky books, bulky files, crates made of wood or like bulky constituents of industrial and/or domestic waste. It has been found that simultaneous feeding of several bulky constituents into the range of the comminuting unit often results in complete breakdown of the entire comminuting apparatus. Furthermore, the apparatus cannot properly process relatively soft constituents of waste, such as paper sheets, cardboard, fragments of textile materials, foodstuffs and the like; such materials are likely to pass through the comminuting unit without undergoing any or by undergoing a negligible comminuting action.

Another drawback of presently known comminuting apparatus, including the apparatus which is disclosed in the aforementioned German publication, is that the comminuted material is not positively expelled from the comminuting unit. For example, fragments of wet cardboard, accumulations of remnants of food or mixtures of remnants of food and adhesive substances are likely to pile up upstream of the outlet to cause clogging of the outlet proper and/or of the comminuting unit. This entails a stoppage of the comminuting unit or the entire apparatus.

OBJECTS AND SUMMARY OF THE INVENTION

An object of the invention is to provide an apparatus which can comminute industrial and/or domestic waste materials (especially bulky items of waste material) to a desired particle size.

Another object of the invention is to provide a versatile apparatus which can comminute different types and/or sizes of waste material and which is constructed and assembled in such a way that non-comminuted, partially comminuted and/or fully comminuted material cannot clog its housing and/or other component parts.

A further object of the invention is to provide the apparatus with a novel and improved comminuting unit.

An additional object of the invention is to provide the apparatus with novel and improved means for advancing waste material or the like into the range of the comminuting unit.

A further object of the invention is to provide the apparatus with novel and improved means for collecting and discharging comminuted material and with novel and improved means for breaking up larger items of waste material ahead of the comminuting station.

An ancillary object of the invention is to provide the comminuting unit of the above outlined apparatus with novel and improved knives.

A further object of the invention is to provide the apparatus with novel and improved means for feeding particles or fragments of material to be comminuted into the range of the knives in the comminuting unit.

Another object of the invention is to provide a comminuting apparatus wherein all component parts which require frequent or periodic inspection are readily accessible.

The apparatus of the present invention comprises a preferably upright housing having an opening for admission of material to be comminuted and including a downwardly tapering section, a comminuting unit disposed below the tapering section of the housing, and a rotary feeding device disposed above the comminuting unit.

The comminuting unit comprises a stationary counterknife disposed below the lower end of the tapering section and including a substantially ring-shaped outer portion whose inner side is disposed below the inner side of the tapering section and at least one wing or arm extending inwardly from the outer portion and having at least one first cutting edge. The arm (preferably a projection at the inner end of the arm) defines a passage or channel for the material which descends below the tapering section. The comminuting unit further comprises at least one rotary knife which is adjacent to the counterknife and has at least one second cutting edge cooperating with the first cutting edge to sever the material which descends below the tapering section. At least the inner side of the tapering section has a downwardly sloping material-advancing spiral surface including an upper portion which flares downwardly and outwardly at a gradually decreasing angle to the axis of the tapering section and a lower portion which flares upwardly and outwardly at a gradually increasing angle to the axis of the tapering section.

The feeding device is disposed above the counterknife and includes at least one arm extending upwardly and outwardly from the axis of the tapering section and having a helical or spiral edge portion whose lead is opposite to that of the spiral surface at the inner side of the tapering section.

If the comminuting unit comprises a single rotary knife, such knife is located below the counterknife. The lower portion of the spiral surface then forms part of the inner side of the counterknife.

If the comminuting unit comprises two rotary knives one of which is located immediately above and the other of which is located immediately below the counterknife, the latter is formed with at least one upper cutting edge which cooperates with one or more cutting edges at the underside of the upper rotary knife and with at least one lower cutting edge which cooperates with one or more cutting edges of the lower rotary knife.

The uppermost part of the upper portion of the aforementioned spiral surface is preferably located in a horizontal plane, i.e., in a plane which is normal to the axis of the rotary knife (the latter is preferably coaxial with the tapering housing section). The upper and lower portions of the spiral surface merge gradually into each other, and the aforementioned angle is or approximates zero in the region of merger of the upper and lower portions of the spiral surface. The lowermost part of the lower portion of the spiral surface preferably merges gradually into the inner side of the tapering section or into the inner side of the counterknife.

The novel features which are considered as characteristic of the invention are set forth in particular in the appended claims. The improved comminuting apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 12 is a perspective view of the lower rotary knife and of a portion of the outlet;

FIG. 16 is a diagram showing the sequence in which fragments or items of waste material are comminuted in the unit of FIG. 5;

FIG. 18*a* is a fragmentary plan view of an outlet having a frustoconical peripheral wall;

FIG. 18*b* is a fragmentary plan view of an outlet having a cylindrical peripheral wall;

FIG. 19 is a fragmentary axial sectional view as seen in the direction of arrows from the line XIX—XIX of FIG. 18*a*; and FIG. 20 is a fragmentary axial sectional view as seen in the direction of arrows from the line XX—XX of FIG. 18*b*.

DESCRIPTION OF THE PREFERRED EMBODIMENTS

Figure 1:
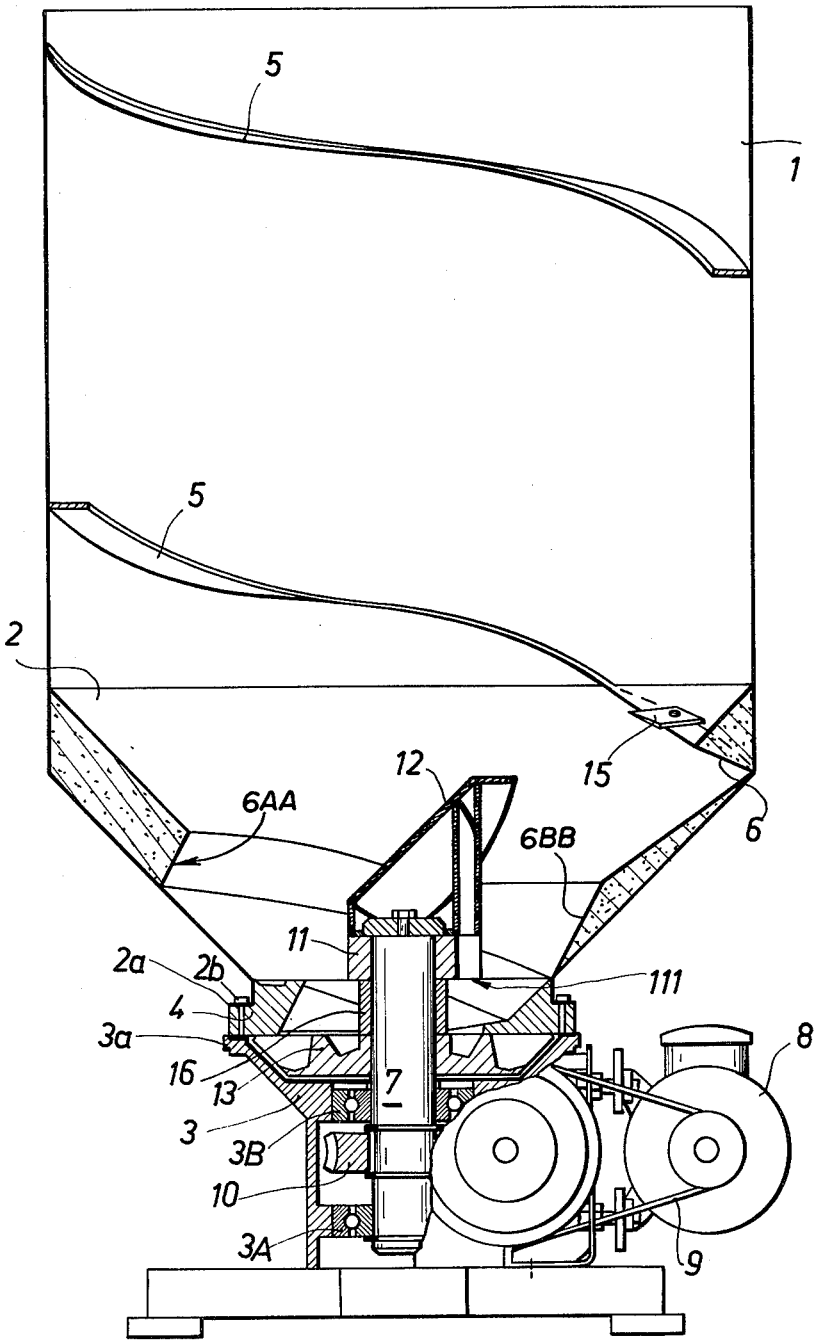
FIG. 1 is a vertical sectional view of an apparatus whose comminuting unit comprises two coaxial rotary knives.
Figure 2:
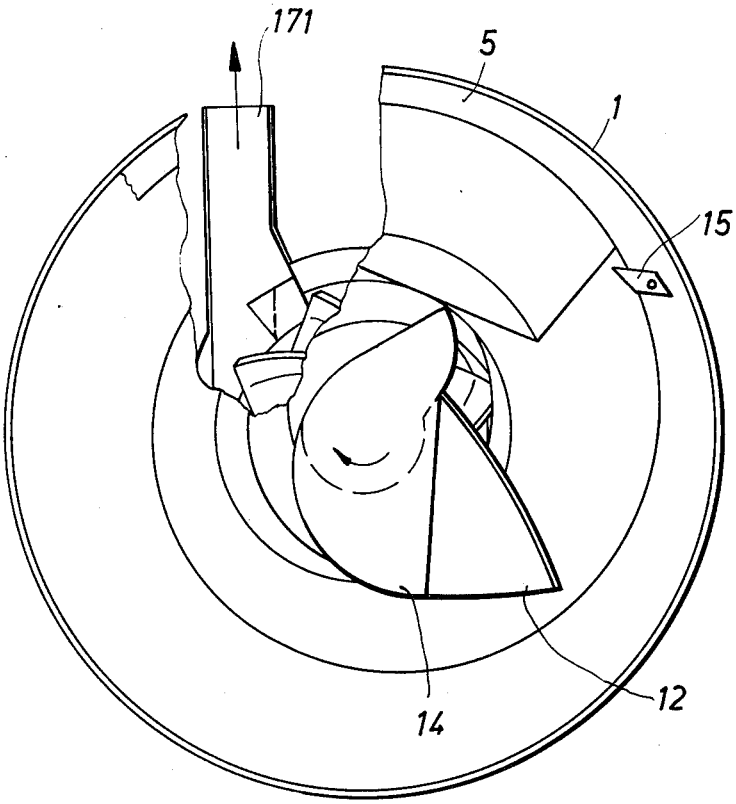
FIG. 2 is a plan view of the apparatus of FIG. 1, with a portion broken away.
Figure 6:
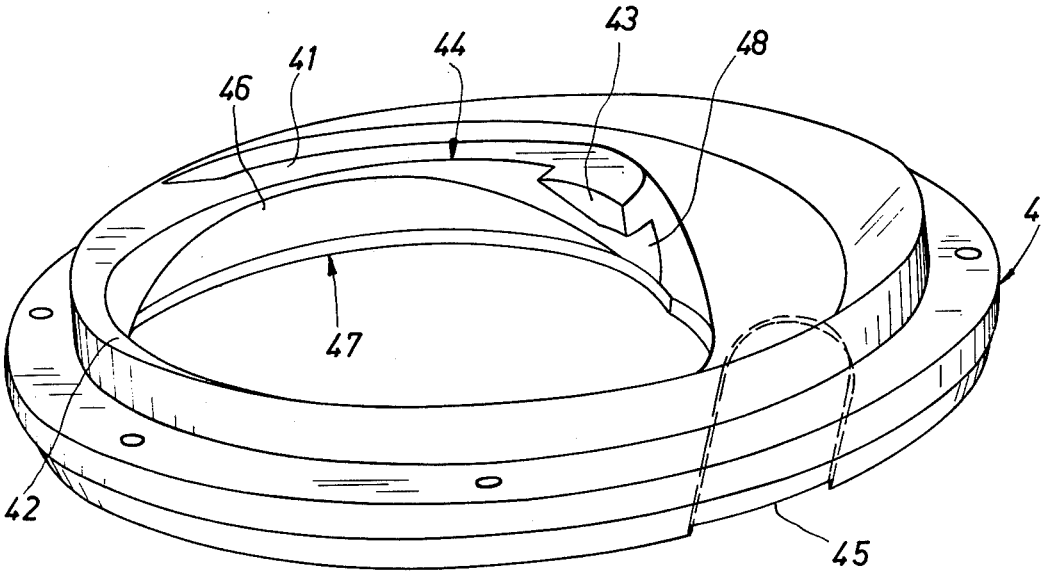
FIG. 6 is an enlarged perspective view of the counterknife in the comminuting unit of FIG. 5.

Referring to FIG. 1, there is shown a comminuting apparatus which embodies one form of the invention. The apparatus includes an upright housing having a cylindrical upper section 1 of constant inner diameter, a funnel-shaped downwardly tapering intermediate section 2 whose diameter decreases gradually in a direction away from the lower end portion of the upper section 1, and a lower section or base 3. A stationary counterknife 4 is installed between the sections 2 and 3; this knife is secured (e.g., by means of bolts 2*b*) to a flange 2*a* at the lower end of the section 2 and a flange 3*a* at the upper end of the section 3. The details of the counterknife 4 are shown in FIG. 6.

Figure 4:
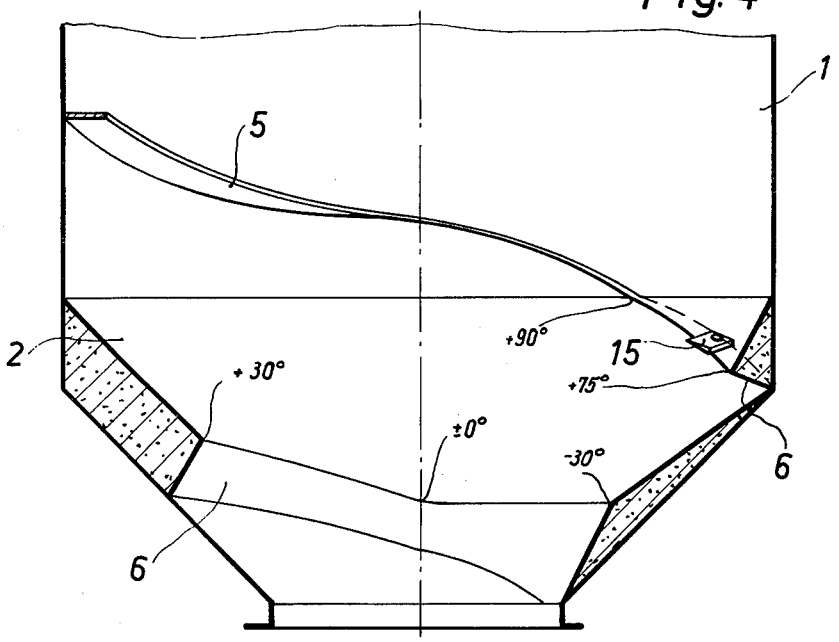
FIG. 4 is a vertical sectional view as seen in the direction of arrows from the line IV—IV of FIG. 3.
Figure 3:
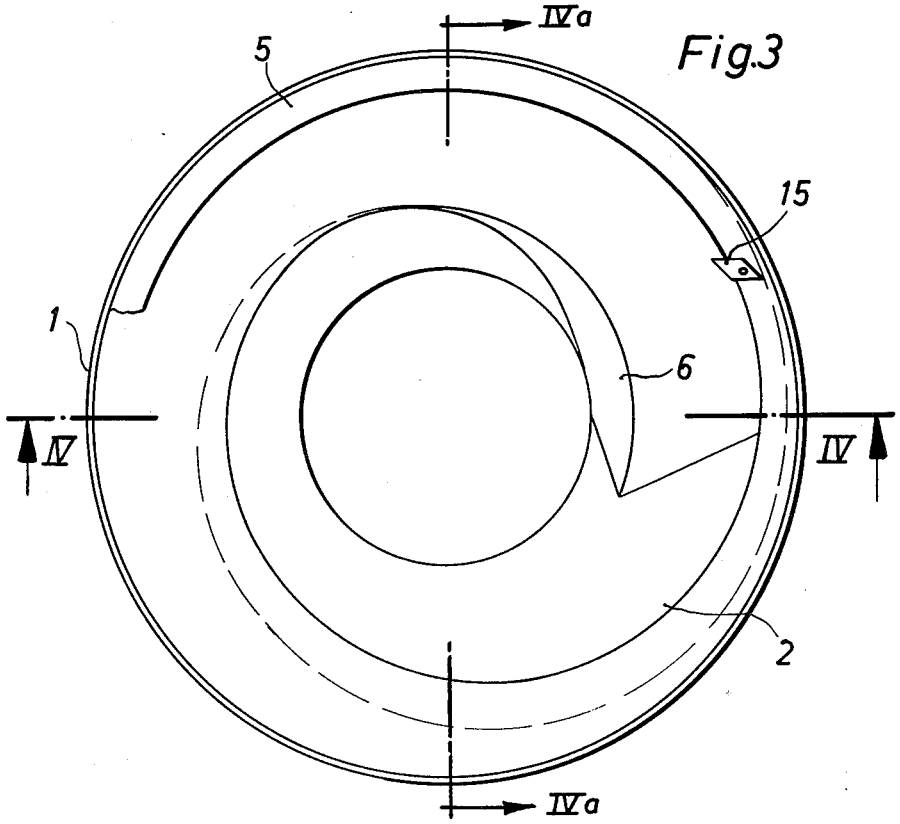
FIG. 3 is a plan view of the cylindrical upper and downwardly tapering intermediate sections of the housing of the apparatus which is shown in FIG. 1.
Figure 4A:
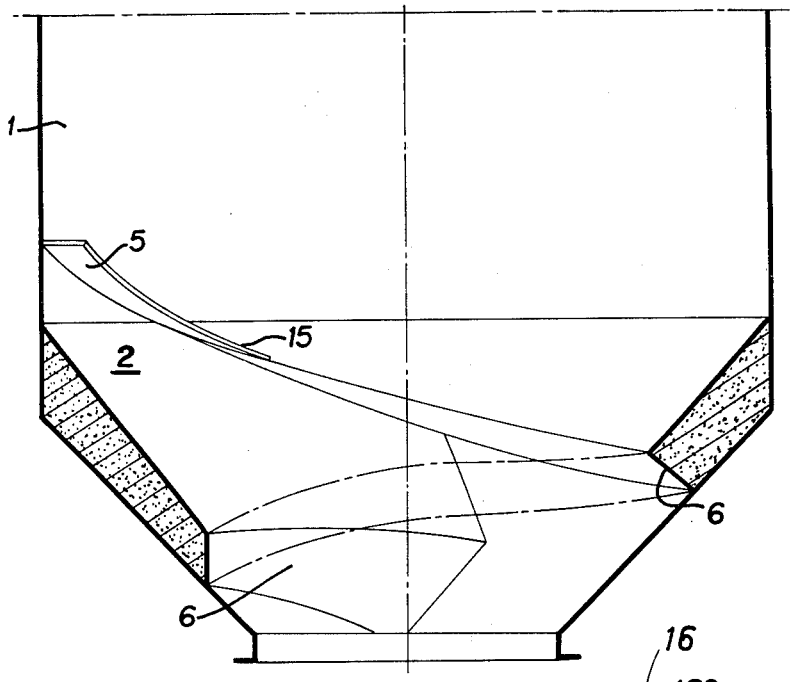
FIG. 4*a* is a vertical sectional view as seen in the direction of arrows from the line IVa—IVa of FIG. 3.

The upper section 1 of the housing is provided with a helical internal projection or rib 5 which serves to guide the admitted waste material downwardly toward and into the downwardly tapering intermediate section 2 of the housing. The rib 5 may consist of suitable metallic material (preferably flat steel strip stock) and each of its increments preferably extends radially of the upper section 1, i.e., at right angles to the vertical axis of the housing including the sections 1 to 3. The upper end portion of the rib 5 is located close to or at the open material-admitting upper end of the section 1, and the lower end portion of this rib preferably extends all the way to the upper end portion of the intermediate section 2 where its underside merges into a spiral internal material-advancing surface 6 forming part of the inner side of the section 2. The inclination of the downwardly sloping spiral surface 6 with respect to the vertical axis of the section 2 varies gradually from 90 degrees to zero degrees and thereupon increases gradually in the opposite direction (see particularly FIG. 4) so that it ultimately matches the inclination of the major part of the inner side of the section 2 directly above the counterknife 4. Thus, the uppermost part of the upper portion of the spiral surface 6 is located in a horizontal plane; the inclination of the upper portion of the surface 6 with respect to the vertical axis of the section 2 thereupon decreases gradually from 90 degrees to zero degrees (i.e., the surface 6AA flares outwardly and downwardly to make a gradually diminishing acute angle with the axis of the section 2); and the lower portion of the spiral surface 6, surface 6BB, flares radially outwardly and upwardly until its lowermost part merges into the major part of the inner side of the section 2. The transition from the upper to the lower portion of the surface 6 is gradual, and the surface 6 and the axis of the housing make an angle of zero degrees in the region where such portions merge into each other.

The lower section 3 contains two coaxial antifriction bearings 3A, 3B for an upright drive shaft 7 which is coaxial with the housing and extends upwardly through and beyond the counterknife 4. The shaft 7 is driven by an electric motor 8 or another suitable prime mover whose frame is secured to the lower section 3 and whose output element transmits torque to the shaft 7 by way of a belt or chain transmission 9 and a worm drive 10. That portion of the shaft 7 which extends upwardly beyond the counterknife 4 drives an upper rotary knife 11 and a feeding device 12 which latter extends substantially centrally into the interior of the intermediate section 2. The shaft 7 further drives a lower rotary knife 13 which is mounted thereon immediately below the counterknife 4. That portion of the shaft 7 which extends through the counterknife 4 is surrounded by and drives a sleeve-like distancing element 16 whose upper and lower end faces respectively abut against the rotary knives 11 and 13. The axial length of the element 16 equals the axial length of the counterknife 4. The knives 4, 11 and 13 constitute the comminuting or severing unit of the apparatus of FIG. 1.

Figure 7:
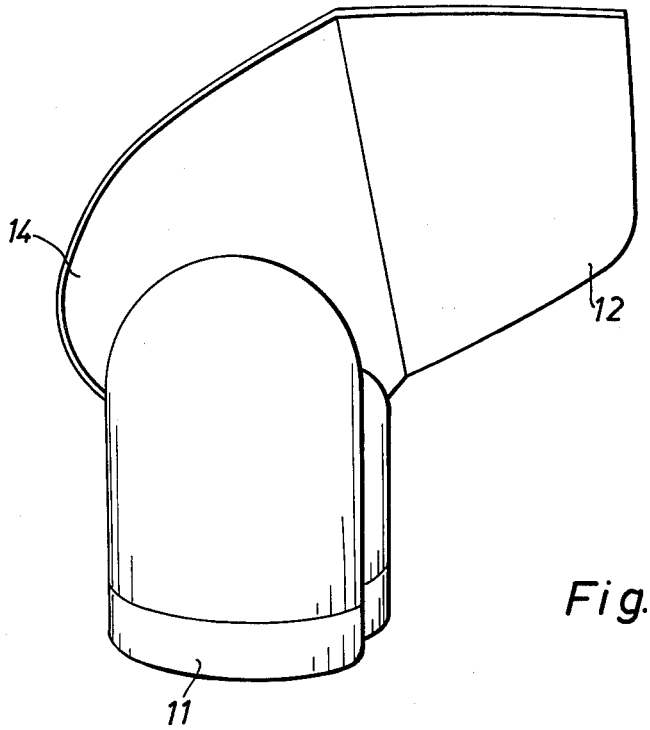
FIG. 7 is a perspective view of a single-armed feeding device which forms part of the comminuting apparatus shown in FIG. 1.
Figure 8:
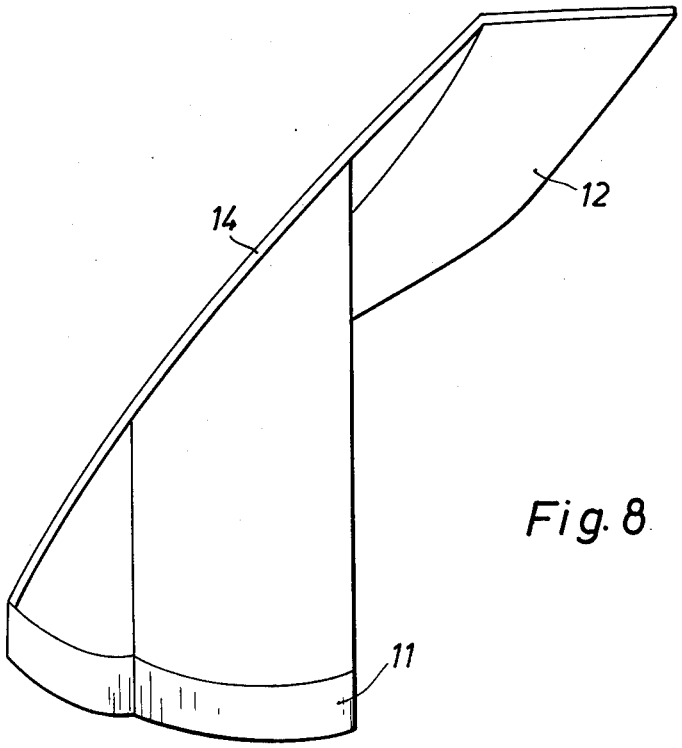
FIG. 8 is another perspective view of the feeding device.
Figure 10:
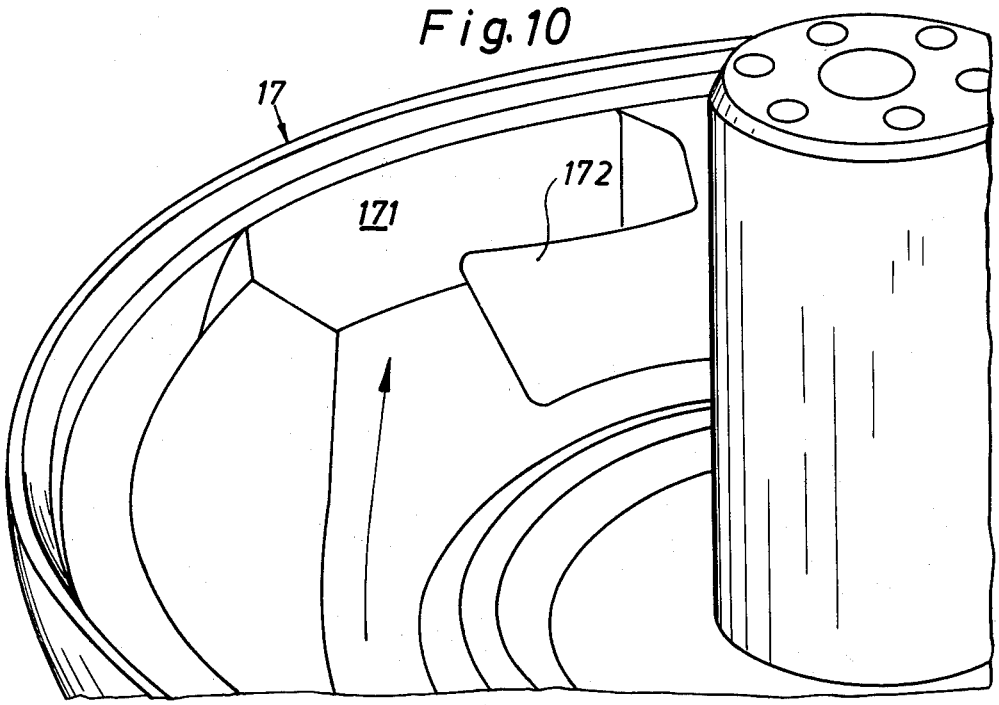
FIG. 10 is an enlarged perspective view of the inner portion of the outlet of the comminuting apparatus of FIG. 1.
Figure 11:
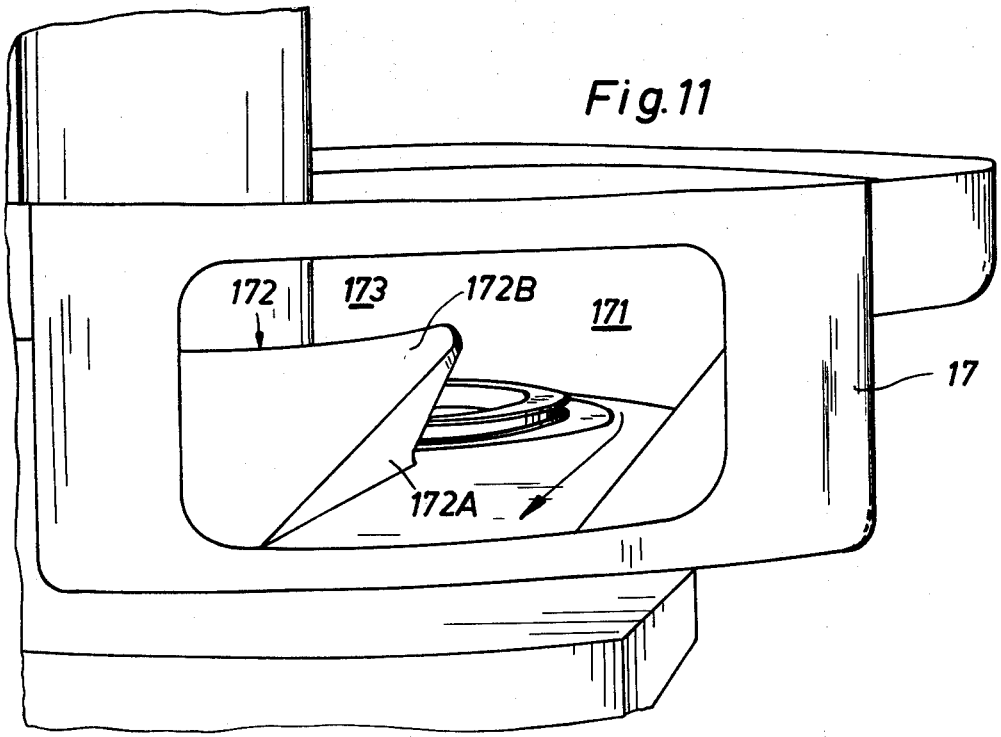
FIG. 11 is a fragmentary perspective view of the exterior of the outlet.

The feeding device 12 may include one or more material engaging and advancing arms and may be made integral with or is separably secured to the upper rotary knife 11. The details of the feeding device 12 are shown in FIGS. 7 and 8. The edge portion of each arm of the device 12 resembles a portion of a helix or spiral and its lead is opposite to that of the material advancing surface 6 in the intermediate section 2 of the housing. In the embodiment of FIG. 1, each arm of the feeding device 12 resembles a spiral whose diameter increases upwardly, i.e., toward the lower end portion of the cylindrical upper housing section 1. Each arm of the feeding device 12 is reinforced or stiffened by a plate 14 which is inclined with respect to the axis of the intermediate section 2. The outline or edge portion of the plate 14 resembles a simplified spiral whose lead is also counter to that of the spiral surface 6. Each arm of the feeding device 12 is spaced apart from the upper rotary knife 11 (see FIGS. 1, 7 and 8); this insures that the device 12 delivers metered quantities of waste material into the range of the comminuting unit 4, 11, 13. The plate 14 is located behind the respective arm, as considered in the direction of rotation of the shaft 7.

Figure 5:
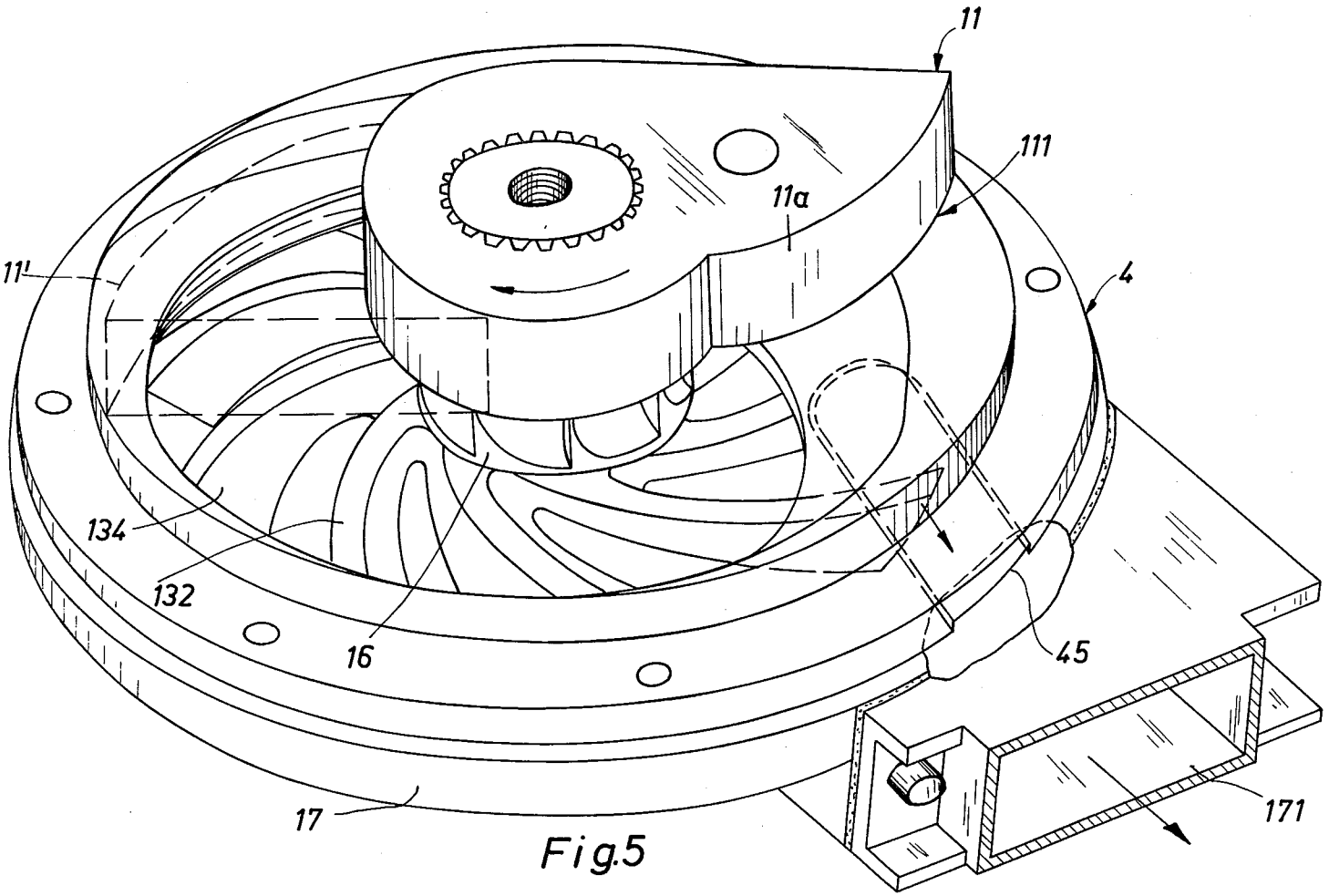
FIG. 5 is an enlarged perspective view of the comminuting unit in the apparatus of FIG. 1, further showing an outlet for collection and evacuation of comminuted material.

FIG. 5 illustrates the details of the upper rotary knife 11. This knife resembles a wing or arm having a convex front surface 11*a* (as considered in the direction of rotation of the drive shaft 7) whose lower end is bounded by an arcuate cutting edge 111 cooperating with the upper cutting edge of the counterknife 4. If desired, the knife 11 may comprise several arms or wings; a second wing is indicated in FIG. 5 by broken lines, as at 11'. If the rotary knife 11 comprises two wings, they are preferably disposed diametrically opposite each other with respect to the axis of the drive shaft 7.

As shown in FIG. 6, the counterknife 4 comprises a substantially sickle-shaped arcuate portion or arm 41 which extends from a ring-shaped outer portion 42 of the counterknife close to the periphery of the distancing element 16 (not shown in FIG. 6). The free inner end portion of the sickle-shaped arm 41 carries a radially inwardly extending projection 43 which extends into close or immediate proximity of the distancing element 16. The aforementioned arcuate cutting edge 111 of the upper rotary knife 11 cooperates with the arcuate upper cutting edge 44 of the arm 41.

The arm 41 further comprises an inclined internal surface 46 which extends downwardly from the cutting edge 44 and all the way or nearly all the way to the flat underside or lower end face of the arm 41. The lower end of the inclined surface 46 is bounded by a second cutting edge 47 which cooperates with the cutting edges of the lower rotary knife 13. The surface 46 is inclined downwardly and outwardly so that the lower cutting edge 47 is more distant from the shaft 7 than the upper cutting edge 44. The aforementioned inwardly extending projection 43 at the free inner end of the arm 41 overlies a passage or channel 48 for partially comminuted material.

Figure 9:
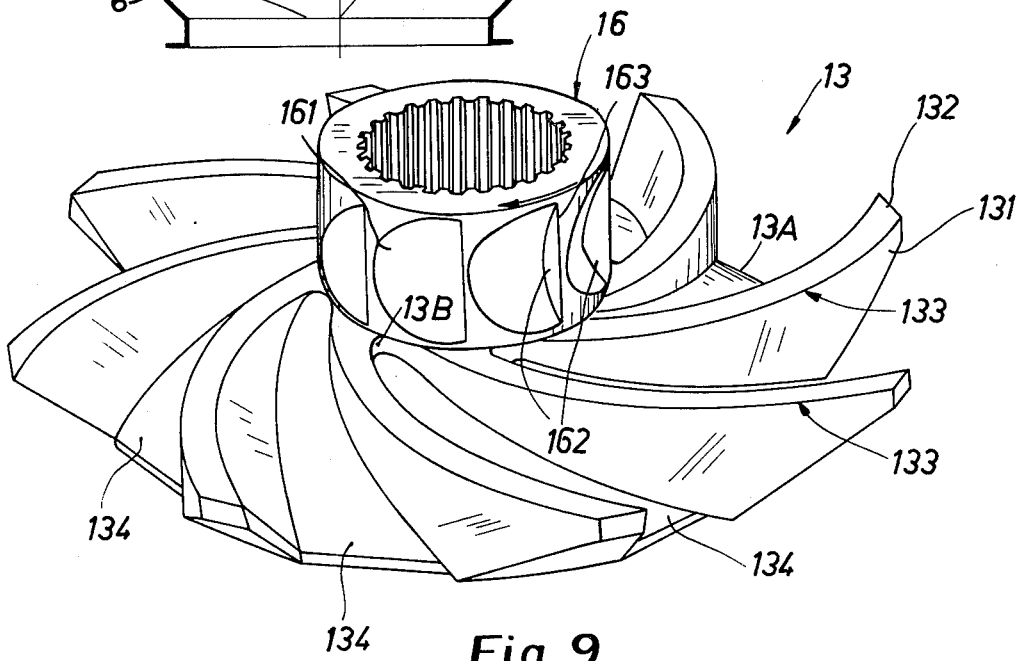
FIG. 9 is a perspective view of the lower rotary knife in the comminuting unit of FIG. 5.

FIG. 9 shows the details of the lower rotary knife 13 which comprises a circular bottom panel 13A having an annulus of equally spaced arcuate blades 131 which extend outwardly from the hub 13B of the knife 13 toward and beyond the periphery of the panel 13A. The width as well as the height of spaces 134 between neighboring blades 131 increases gradually in a direction from the distancing element 16 toward the tips of the blades 131. Each blade 131 has a flat upper end face 132 which is adjacent to the flat underside of the counterknife 4 and whose front side is bounded by a convex cutting edge 133 cooperating with the lower cutting edge 47 of the arm 41.

FIG. 9 further shows that the peripheral surface of the distancing element 16 is formed with an annulus of wedge like recesses 161 whose trailing ends are bounded by shoulders 162 preferably disposed in planes which include the axis of the shaft 7. The edges 163 at the outer ends of the shoulders 162 are preferably sharp to contribute to advancement as well as to comminution of waste material.

The periphery and underside of the lower rotary knife 13 are surrounded by a casing 17 which constitutes an outlet for comminuted material and the details of which are shown in FIGS. 5, 10, 11 and 12. The casing 17 includes a material discharging duct 171 having a rectangular cross-sectional outline and extending substantially tangentially of the drive shaft 7. Furthermore, the casing 17 includes a suitably inclined baffle 172 which extends into the interior of the duct 171 and serves to classify the comminuted and partially comminuted materials. Thus, the baffle 172 permits unimpeded or practically unimpeded evacuation of fully comminuted material by way of the duct 171; however, the baffle 172 intercepts and changes the direction of movement of certain relatively long strips or strands of waste material, namely, such strips or strands which could cause clogging of the duct 171 and/or would tend to dwell in the cutting zone. The inclination of the material engaging face 172A of the baffle 172 is such that it forces certain longer strands of waste material to move upwardly into a clearance 173 between the baffle and the flat underside of the counterknife 4; such strands thereupon reenter the duct 171 and are free to leave the apparatus.

The operation:

Waste material to be comminuted is admitted into the upper cylindrical section 1 of the housing. Such material may include constituents having a maximum size approximately two-thirds of the inner diameter of the section 1. The larger constituents of waste material are engaged by the feeding device 12 and are forced against a plate- or blade-like deforming, ripping or breaking projection 15 which is secured to the housing section 2 and extends inwardly beyond the respective portion of the material-advancing spiral surface 6. The projection 15 cooperates with the feeding device 12 to reduce the size of larger constituents of waste material. This projection is capable of reducing the size of constituents whose maximum dimension not only approximates but actually exceeds two-thirds of the inner diameter of the cylindrical section 1.

The particles of waste material which advance downwardly beyond the ripping projection 15 travel between the rotating feeding device 12 and the intermediate section 2 by sliding along the surface 6. This reduces the dimensions of the descending material to such an extent that the material can enter the comminuting unit including the knives 4, 11 and 13. It will be noted that the surface 6 resembles a spiral whose diameter decreases downwardly, i.e., toward the upper rotary knife 11 of the comminuting unit. As the material descends, its particles move around the edge portion of the arm of and advance to a level below the feeding device 12. The particles are thereupon released and again engaged by the arm of the device 12 to be forced into the comminuting unit. Such mode of operation of the feeding device 12 is desirable and advantageous because, if the accumulation of waste material below the device 12 is excessive, some material can escape by moving radially outwardly at the lower end of the device 12 and to thereupon return into the range of the feeding device so as to be forced into the comminuting unit. The aforediscussed configuration of the lower portion of the surface 6 serves a similar purpose. Thus, if the lower portion of the intermediate housing section 2 receives excessive quantities of condensed or compacted waste material, the lower portion of the surface 6 (this lower portion flares upwardly and outwardly) allows excess material to move upwardly and to reenter the zone immediately above the rotating knife 11 when the volume of accumulated material immediately upstream of the comminuting unit is reduced.

Those parts and fragments of waste material which descend to the level of the stationary counterknife 4 are comminuted by the cooperating cutting edges 111 of the upper rotary knife 11 and the upper cutting edge 44 of the arcuate arm 41. The cutting edges 111 and 44 cooperate to remove shreds from the lower end of the column of descending waste material (note the first comminuting stage 1 in the diagram of FIG. 16). The column of waste material continues to descend and its leading end is severed during each revolution of the wing or wings of the upper rotary knife 11. The maximum width of fragments which advance downwardly beyond the first or upper cutting station equals or approximates the height of the counterknife 4, i.e., the axial length of the distancing element 16. The weight of oncoming fragments automatically urges the severed shreds to move downwardly and to enter the second station of the comminuting unit, namely, the region between the counterknife 4 and the lower rotary knife 13. Such fragments are severed by the lower cutting edge 47 of the arm 41 in cooperation with the cutting edges 133 of the blades 131 (see the second comminuting stage in FIG. 16). The shreds which are obtained in response to severing of waste material by the knives 4 and 13 resemble parallelograms owing to aforementioned inclination of the internal surface 46 of the counterknife 4. Such shreds enter the spaces 134 between the blades 131 of the lower rotary knife 13. Any fragments which remain at a level above the lower cutting edge 47 of the counterknife 4 advance through the passage or channel 48 below the projection 43 and are introduced into the second cutting station during next revolution or revolutions of the lower rotary knife 13.

In the absence of the passage 48 (i.e., if the projection 43 of the arm 41 were to extend all the way to the distancing element 16 along the full axial length of the counterknife 4), any remnants of severed material which would fail to descend into the spaces 134 between the blades 131 of the lower rotary knife 13 would accumulate in the space between the surface 46 and the projection 43 of the counterknife 4. The accumulated material would form a compact wedge which could interrupt the operation of the entire comminuting apparatus.

The parallelogram-shaped fragments which enter the spaces 134 between the blades 131 of the lower rotary knife 13 are urged radially outwardly toward the tips of the adjacent blades 131 as a result of entry of additional fragments and leave the outlet 17 via duct 171 continuously or at intervals of identical or different length.

When the material to be comminuted includes sheet metal and/or relatively thick and strong plastic substances which are likely to yield elongated strips or strands, the aforementioned baffle 172 in the casing 17 intercepts such strips and its face 172A directs the intercepted elongated particles upwardly so that they pass through the clearance 173 and reenter the duct 171 in such orientation that they can bypass the baffle 172. This can be readily achieved if the width of the opening defined by the duct 171 plus the width of the clearance 173 slightly exceeds the maximum anticipated length of fragments. The maximum length of the fragments is determined by the length of spaces 134 between the blades 131 of the lower rotary knife 13 (such length is measured in a direction from the hub 13B toward the tips of the blades 131).

The apparatus which is shown in FIGS. 1 to 12 is constructed and assembled in such a way that the cutting edges of the knives 4, 11 and 13 sever waste material in a direction toward the axis of the shaft 7, i.e., in a direction inwardly from the peripheral portion of the lower housing section 3. This is due to the aforedescribed curvature of the cutting edges 111, 44, 47 and 133, it being assumed that the shaft 7 is driven to rotate clockwise, as viewed in FIG. 2, 5, 6, 9 or 12. However, it is equally within the purview of the invention to select the curvature of cutting edges and/or the direction of rotation of rotary knives 11, 13 in such a way that the cutting action progresses radially outwardly. Such cutting action is especially desirable when the cutting edges of the knives 4, 11 and 13 are straight.

If the apparatus is large, i.e., if it is designed to comminute extremely large and bulky items of waste material, it is advisable to assemble some or all of the knives of several parts, namely of a holder which may consist of cast steel or like metallic material and carries one or more separable blades made of high-quality steel which can stand long periods of use but being replaceable by fresh blades in the event of excessive wear and/or other damage.

In addition to effecting a preliminary comminution of waste material, the upper rotary knife 11 performs a desirable material advancing or conveying action. The size of fragments which issue via discharge duct 171 of the outlet or casing 17 depends primarily on the number of cutting edges 133, i.e., on the number of cutting blades 131 in the lower rotary knife 13. Thus, the intensity of comminuting action can be influenced by the simple expedient of replacing a lower rotary knife 13 having a given number of blades 131 with another rotary knife having a larger number of blades.

The illustrated inclination of the conical inner side of the intermediate section 2 (approximately 45 degrees with respect to the axis of the shaft 7) is desirable but not crucial. All that counts is to insure that the inclination of the inner side of the section 2 will suffice to insure that this section promotes downward and inward movement of waste material under the action of gravity. The slope of the surface 6 in the section 2 can also vary within a rather wide range; such slope depends on the desired advancing action of the surface 6, i.e., on the desired degree of forcible transport of waste material toward that region where the angle between the surface 6 and the axis of the shaft 7 equals or approximates zero. The advancing action is reduced by reducing the slope of the upper portion of the surface 6, and vice versa. The slope of the surface 6 is further influenced by the number of cutting edges on the counterknife 4 as well as by other parameters (such as the configuration and dimensions) of the comminuting unit.

The lower rotary knife 13 can resemble the frustum of a cone, or it may constitute a substantially cylindrical body. The configuration of the outlet 17 conforms to the configuration of the knife 13, i.e., the outlet surrounds the periphery and the underside of the lower rotary knife. FIGS. 18*a* and 19 show a casing or outlet 317 with a substantially frustoconical peripheral wall 317A. FIGS. 18*b* and 20 show a casing or outlet 417 having a substantially cylindrical peripheral wall 417A. The angle between the aforementioned inclined face 172A and the upper face 172B (see FIG. 11) of the baffle 172 is preferably between 45 and 90 degrees.

The housing of the improved comminuting apparatus can employ a modified upper section (corresponding to the section 1 of FIG. 1) which is provided with two or more internal helical projections or ribs 5. If the section 1 is formed with or supports several ribs 5, such ribs are preferably parallel to and equally spaced apart from each other. The same applies for the intermediate section 2, i.e., this section can be provided with two or more discrete material-advancing spiral surfaces 6 which are preferably parallel to and equally spaced apart from each other.

Still further, and as already mentioned above, the feeding device 12 of FIGS. 7 and 8 can be replaced with a feeding device having two discrete arms or wings which are preferably located diametrically opposite each other. A feeding device which includes several arms or wings produces a superior ripping or breaking action, i.e., the cooperation with the projection 15 is even more reliable to insure that each large item of waste material is deformed, ripped or broken up into smaller fragments not later than when it moves to a level below the feeding device. It is also possible to furnish the apparatus with two or more interchangeable feeding devices each of which has a different number of arms.

Analogously, the upper rotary knife 11 may be provided with one, two or more arcuate or otherwise configurated arms or wings each of which has a discrete convex, concave or straight cutting edge. In other words, the number of arms or wings on the knife 11 can be increased beyond that (two) which is shown in FIG. 5. If the knife 11 comprises several arms or wings, such wings are preferably equidistant from each other, as considered in the circumferential direction of the drive shaft 7. If the apparatus is furnished with two or more feeding devices 12 and two or more knives 11, it is possible to select any desired practical combination of parts 11 and 12 to insure satisfactory non-cutting comminution of larger items of waste at a level above the comminuting unit and a desirable preliminary cutting of waste material at the upper station of the comminuting unit (i.e., between the knives 11 and 4). The apparatus will preferably employ a feeding device 12 with a single arm when the waste material includes a relatively high percentage of strip- or web-shaped constituents including marginal portions of foils, elongated strips of floor covering material, elongated strips of plastic bags and/or the like. A feeding device with several arms would act not unlike a reel or winch, i.e., strips or webs of waste material would tend to become convoluted around the feeding device. Finally, the feeding action of the device 12 can be altered or modified by changing the lead of its spiral edge portion or by providing several spiral edge portions, one above the other, so that the device 12 will urge and convey waste material toward the comminuting unit with a force which is best suited for uniform comminution of certain types of waste material.

Referring again to FIGS. 5 and 6, the flat underside of the counterknife 4 is formed with a relatively shallow channel or groove 45 which extends substantially tangentially of the distancing element 16 and whose underside is open toward the lower rotary knife 13. The depth of the groove 45 may be a fraction of one centimeter, e.g., in the range of between 4 and 6 millimeters. The inner end of the groove 45 is closed and is located above the path of orbital movement of blades 131 forming part of the lower rotary knife 13. The outer end of the groove 45 is open and communicates with the interior of the duct 171. Such configuration of the counterknife 4 insures that any particles or fragments which enter the groove 45 and extend downwardly beyond the underside of the counterknife 4 are located in the path of movement of cutting edges 133, i.e., such particles or fragments are forcibly introduced into the duct 171 to promote evacuation of the contents of this duct which discharges comminuted waste material into a suitable receptacle, vehicle or the like, not shown.

Figure 13:
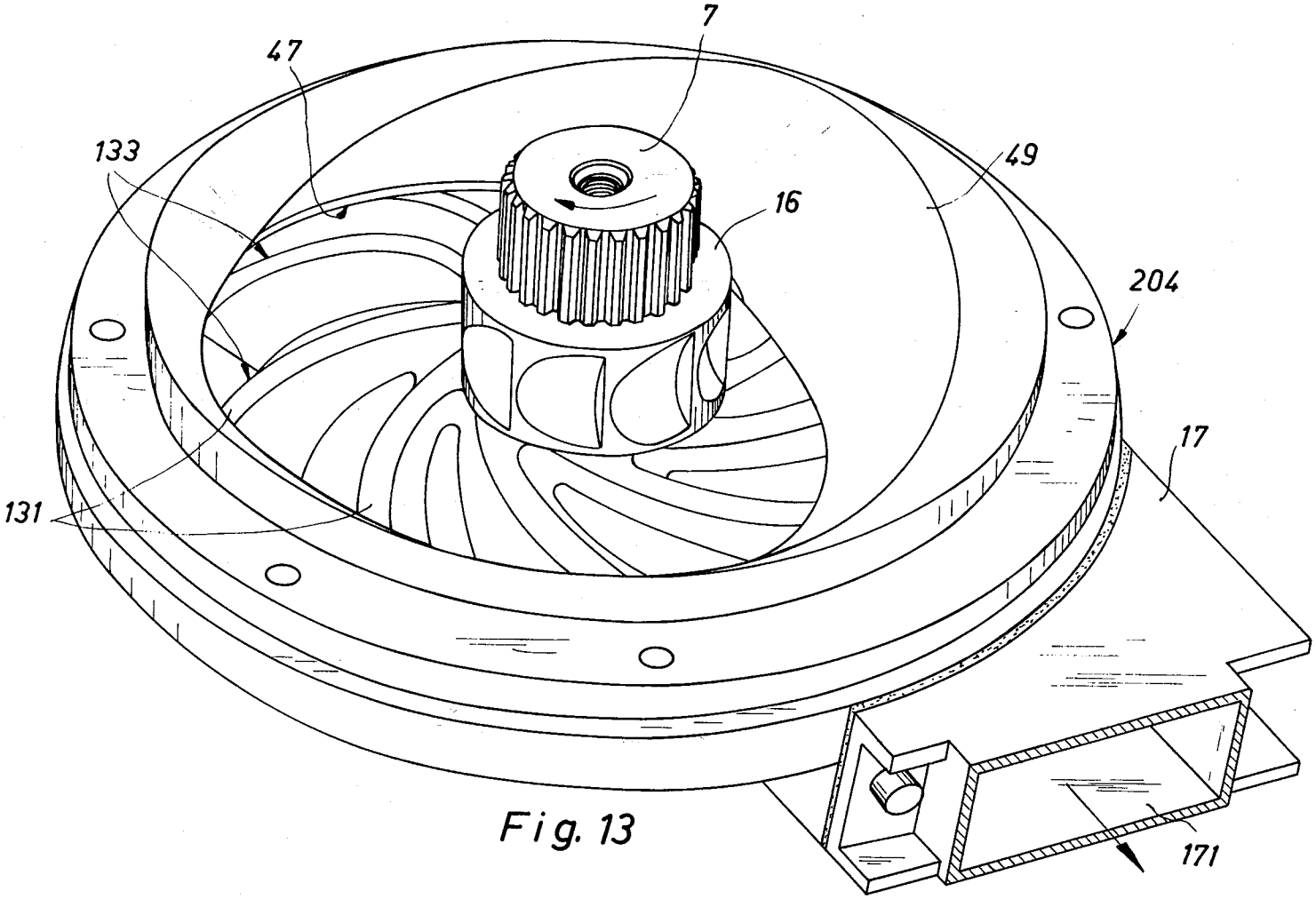
FIG. 13 is a perspective view of a modified comminuting unit which comprises a single rotary knife disposed below the counterknife.

FIG. 13 illustrates the comminuting unit and the outlet of a modified apparatus which comprises a stationary counterknife 204 and a single rotary knife, namely, the lower rotary knife 13. Therefore, the counterknife 204 comprises a single (lower) cutting edge 47 which cooperates with the cutting edges 133 of arcuate blades 131 forming part of the single rotary knife 13. The upper portion of the counterknife 204 is configurated in such a way that its inner side constitutes a downward extension of the inner side of the intermediate housing section 202 (FIGS. 14 and 15) and includes the lower portion of the spiral surface 206. The upper portion of the surface 206 forms part of the inner side of the section 202. To this end, the lower part of the upper portion of the surface 206 does not merge all the way into the major part of the inner side of the section 202. The lower portion 49 of the surface 206 in the counterknife 204 changes its inclination with respect to the axis of the section 202 in such a way that it flares outwardly and upwardly, i.e., that the surface portion 49 is capable of urging excess waste material upwardly and out of the cutting station whereby the upwardly displaced material enters the cutting station after a certain period of dwell in the section 202, namely, when the quantity of waste material above the counterknife 204 is not excessive. The portion 49 of the spiral surface 206 further contributes to enlargement of the passage 48 below the projection 43 (not shown) of the counterknife 204.

Figure 15:
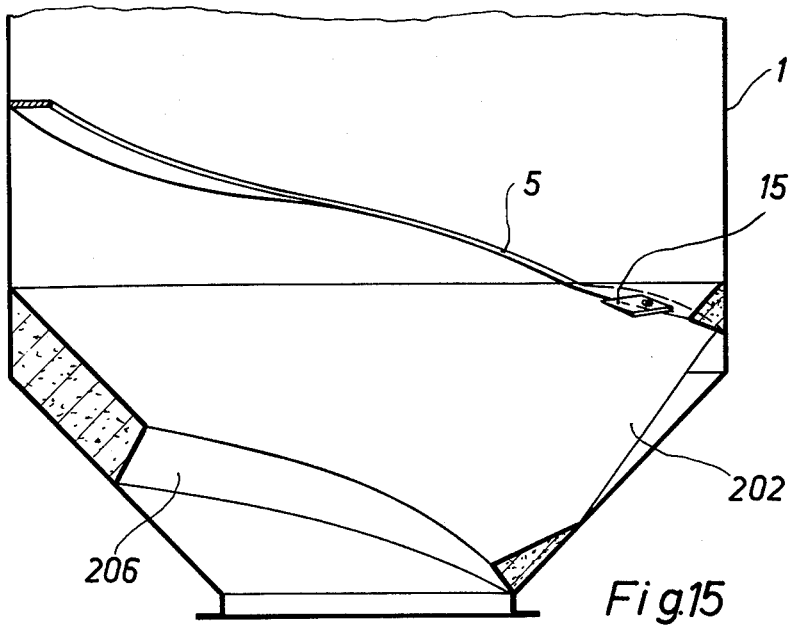
FIG. 15 is an axial sectional view as seen in the direction of arrows from the line XV—XV of FIG. 14.

FIG. 15 shows that the lowermost part of the upper portion of the surface 206 of the intermediate housing section 202 and the vertical axis of the section 202 make an acute angle of approximately 45 degrees. This angle decreases gradually to zero in the counterknife 204 and thereupon begins to increase but in the opposite direction (see the aforementioned surface portion 49). The angle between the uppermost part of spiral surface 206 in the intermediate housing section 202 and the vertical axis of this section is preferably 90 degrees. As mentioned above, this angle decreases to approximately 45 degrees at the lower end of the section 202. In other words, that portion of the surface 206 which forms part of the section 202 serves as a means for advancing waste material downwardly toward the interior of the counterknife 204; this does not represent a drawback because any excess of waste material which reaches the cutting station (at the level of the cutting edges 47 and 133) can rise upwardly along the surface portion 49 and by advancing through the passage 48 below the projection 43 of the counterknife 204. The passage of the counterknife 204 is larger than the passage 48 of the counterknife 4 due to the provision of surface portion 49 in the part 204.

Figure 14:
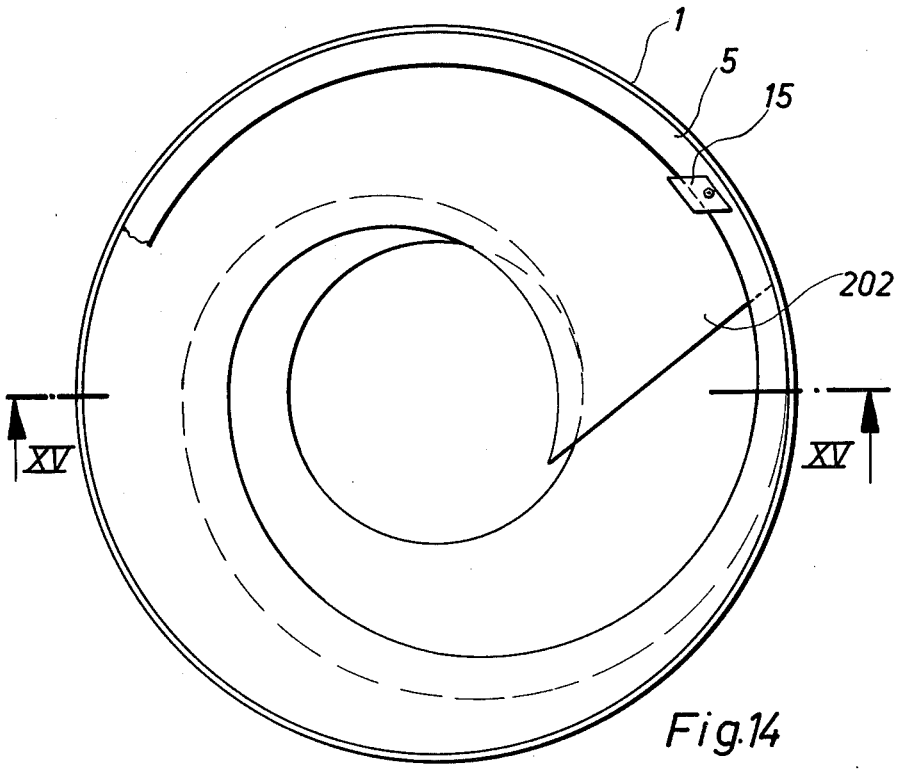
FIG. 14 is a plan view of the downwardly tapering section of the housing in the apparatus which embodies the comminuting unit of FIG. 13.
Figure 17:
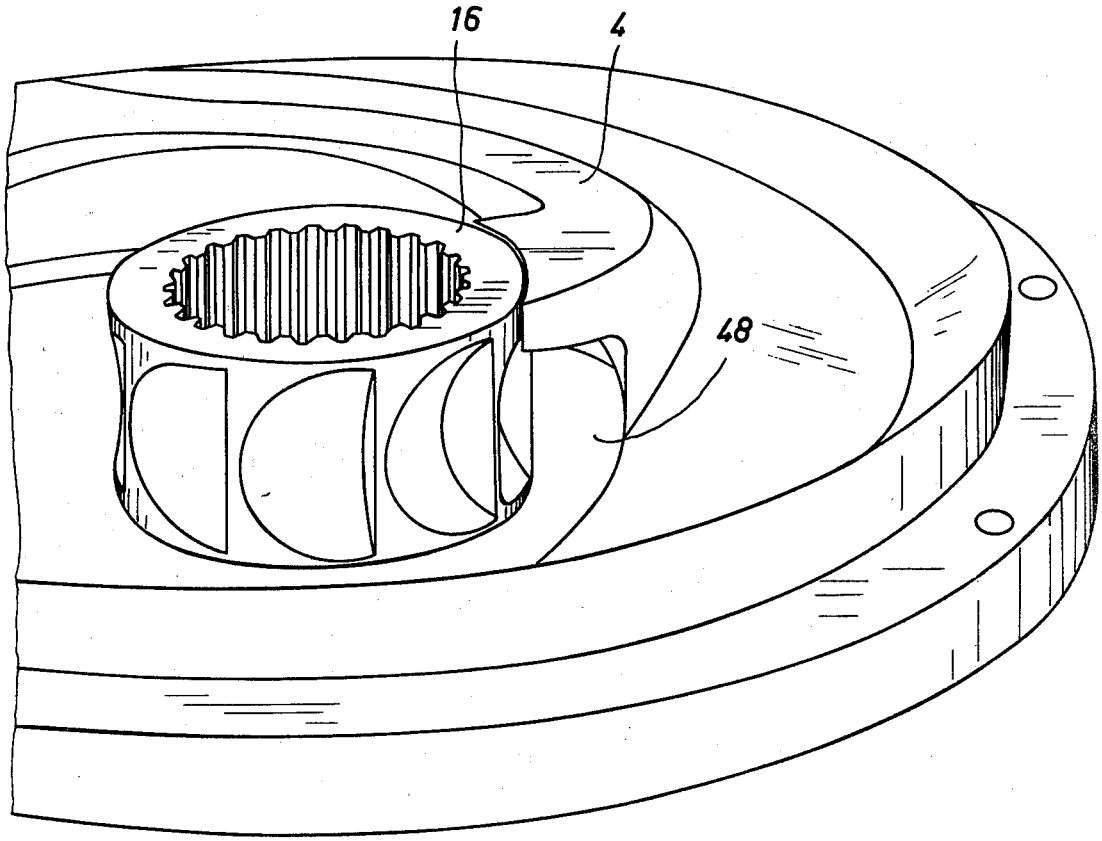
FIG. 17 is an enlarged perspective view of a distancing element in the comminuting apparatus, further showing a portion of the surrounding counterknife.

The feeding device 12 of the apparatus which embodies the structure of FIGS. 13 to 15 is mounted immediately above the distancing element 16, i.e., it extends downwardly all the way to the level of the upper side of the counterknife 204.

The quality of comminuting action of the apparatus of FIGS. 13–15 can match or approximate that of the apparatus of FIGS. 1 to 12 by the simple expedient of increasing the number of blades 131 and cutting edges 133 on the single rotary knife 13 of FIG. 13. The number of upper and lower cutting edges on the counterknife 4 or 204, i.e., the number of arms 41, depends on the nature of waste material which is to be treated, on the dimensions of the apparatus and on the desired output of the apparatus.

Without further analysis, the foregoing will so fully reveal the gist of the present invention that others can, by applying current knowledge, readily adapt if for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. In a comminuting apparatus, particularly for waste materials or the like, the combination of (a) a housing having an opening for admission of material to be comminuted, said housing including a downwardly tapering upright section having an inner side;

(b) a comminuting unit including a stationary counterknife disposed below said section and comprising a substantially ring-shaped outer portion having an inner side disposed below the inner side of said section and at least one arm extending inwardly from said outer portion and having a cutting edge, said arm defining a passage for the material which descends beyond said section, and at least one rotary knife adjacent to said counterknife and having at least one cutting edge cooperating with the cutting edge of said counterknife to sever the material which descends beyond the inner side of said section, at least the inner side of said upright section having a downwardly sloping material-advancing spiral surface and said spiral surface including an upper portion which flares downwardly and outwardly at a gradually decreasing angle to the axis of said section and a lower portion which flares upwardly and outwardly at a gradually increasing angle to said axis; and (c) a rotary feeding device disposed above said counterknife and including at least one arm extending upwardly and outwardly from the axis of said section and having a helical or spiral edge portion whose lead is opposite to that of said spiral surface.

2. The combination of claim 1, wherein the upper portion of said spiral surface has an uppermost part disposed in a plane which is at least substantially normal to the axis of said section, said upper and lower portions of said spiral surface merging gradually into each other and said angle being zero in the region of merger of said upper and lower portions into each other, said lower portion of said spiral surface having a lowermost part which merges gradually into the respective inner side.

3. The combination of claim 1, further comprising a drive shaft for said rotary knife and said feeding device, said arm of said counterknife extending inwardly toward said shaft and said passage being adjacent to said shaft.

4. The combination of claim 3, further comprising a substantially sleeve-like rotary distancing element surrounding said shaft within the confines of said counterknife.

5. The combination of claim 1, wherein said edge portion of said feeding device is a spiral whose diameter increases in a direction upwardly and away from said counterknife and said feeding device further comprises a substantially plate-like reinforcing member for said arm of said feeding device.

6. The combination of claim 5, wherein said reinforcing member is located behind said last mentioned arm, as considered in the direction of rotation of said feeding device, said reinforcing member having the configuration of a helix or spiral with a lead opposite to that of said spiral surface.

7. The combination of claim 1, wherein said rotary knife is disposed below said counterknife and comprises a substantially circular bottom panel and an annulus of blades disposed above said panel and extending outwardly from the axis of said rotary knife, each of said blades having a cutting edge and the neighboring blades of said annulus defining spaces for the passage of comminuted material.

8. The combination of claim 7, wherein the blades of said annulus are equidistant from each other and the width and depth of said spaces increase gradually in a direction radially outwardly from the axis of said rotary knife.

9. The combination of claim 7, wherein the cutting edges of said blades are arcuate.

10. The combination of claim 7, wherein said rotary knife has a periphery and further comprising an outlet surrounding the periphery and the panel of said rotary knife, said outlet having a material discharging duct extending substantially tangentially of the axis of said rotary knife.

11. The combination of claim 10, wherein said outlet further includes a baffle extending into the interior of said duct and defining with said counterknife a second passage for elongated fragments of comminuted material, said baffle having an inclined face arranged to direct such fragments into said second passage and said second passage communicating with the interior of said duct.

12. The combination of claim 1, wherein said rotary knife is disposed immediately below said counterknife and said unit further comprises a second rotary knife disposed immediately above said counterknife.

13. The combination of claim 12, further comprising a common upright drive shaft for said rotary knives.

14. The combination of claim 12, wherein said counterknife has an upper and a lower cutting edge and said second rotary knife has at least one arcuate cutting edge orbiting immediately above said upper cutting edge.

15. The combination of claim 1, further comprising an upright drive shaft for said rotary knife and said feeding device, said shaft extending through said counterknife and further comprising a sleeve-like rotary distancing element surrounding said shaft within the confines of said counterknife and having a peripheral surface provided with an annulus of substantially wedge-like recesses.

16. The combination of claim 15, wherein said peripheral surface has shoulders bounding the rear portions of said recesses, as considered in the direction of rotation of said distancing element, said shoulders being disposed in planes including the axis of said shaft and each of said shoulders having a sharp outer edge.

17. The combination of claim 1, wherein said unit comprises a single rotary knife disposed below said counterknife, said lower portion of said spiral surface being provided at the inner side of said counterknife.

18. The combination of claim 1, wherein said housing further includes a substantially cylindrical second section disposed above said downwardly tapering section and having an inner side provided with at least one downwardly sloping helical projection each portion of which extends substantially radially of the axis of said second section.

19. The combination of claim 18, wherein said projection has a lowermost portion adjacent to the uppermost part of the upper portion of said spiral surface.

20. The combination of claim 1, wherein said unit comprises coaxial upper and lower rotary knives respectively located immediately above and immediately below said counterknife, said arm of said counterknife having upper and lower cutting edges respectively adjacent to said upper and lower rotary knives, said arm of said counterknife further having a surface extending between said upper and lower cutting edges and being inclined downwardly and outwardly with respect to the common axis of said rotary knives.

21. The combination of claim 1, wherein said unit comprises first and second rotary knives respectively disposed immediately above and immediately below said counterknife, said arm of said counterknife having an inner end portion provided with a projection overlying said passage.

22. The combination of claim 1, wherein said section comprises a material ripping projection cooperating with said feeding device and being adjacent to and extending inwardly from the upper portion of said spiral surface.

23. The combination of claim 1, wherein said one rotary knife is disposed below said counterknife and further comprising an outlet surrounding the periphery and the underside of said rotary knife and having a material discharging duct, said counterknife having an underside provided with a groove communicating with the interior of said duct.

24. The combination of claim 23, wherein said groove has a closed inner end and an open outer end communicating with said duct, said groove extending substantially tangentially of the axis of said rotary knife and the depth of said groove being a fraction of one centimeter.

25. The combination of claim 24, wherein said rotary knife has a plurality of substantially radially outwardly extending blades each of which is provided with a cutting edge, said blades being arranged to orbit past that portion of said groove which is adjacent to said closed inner end.

* * * * *